US010599071B2

(12) United States Patent
Perez et al.

(10) Patent No.: US 10,599,071 B2
(45) Date of Patent: Mar. 24, 2020

(54) TONER CARTRIDGE AND METHOD OF SEALING THE SAME

(71) Applicant: CLOVER IMAGING GROUP, LLC, Hoffman Estates, IL (US)

(72) Inventors: Jesus Gonzalez Perez, Chatsworth, CA (US); Oswaldo Cota, North Hills, CA (US)

(73) Assignee: CLOVER IMAGING GROUP, LLC, Hoffman Estates, IL (US)

( * ) Notice: Subject to any disclaimer, the term of this patent is extended or adjusted under 35 U.S.C. 154(b) by 0 days.

(21) Appl. No.: 16/077,716

(22) PCT Filed: Apr. 17, 2017

(86) PCT No.: PCT/US2017/027888
§ 371 (c)(1),
(2) Date: Aug. 13, 2018

(87) PCT Pub. No.: WO2017/184490
PCT Pub. Date: Oct. 26, 2017

(65) Prior Publication Data

US 2019/0361375 A1 Nov. 28, 2019

Related U.S. Application Data

(60) Provisional application No. 62/325,020, filed on Apr. 20, 2016.

(51) Int. Cl.
*G03G 15/08* (2006.01)

(52) U.S. Cl.
CPC ..... *G03G 15/0898* (2013.01); *G03G 15/0894* (2013.01)

(58) Field of Classification Search
CPC ..... G03G 15/0817; G03G 15/0882; G03G 15/0894; G03G 15/0898; G03G 2215/0687
See application file for complete search history.

(56) References Cited

U.S. PATENT DOCUMENTS

| | | | | |
|---|---|---|---|---|
| 5,110,646 | A | 5/1992 | Prestel et al. | |
| 5,621,508 | A | 4/1997 | McNamara | |
| 5,671,461 | A | 9/1997 | Ishii | |
| 7,076,186 | B1 | 7/2006 | Michlin et al. | |
| 9,164,430 | B2 | 10/2015 | Murakami et al. | |
| 2002/0054771 | A1 | 5/2002 | Higeta et al. | |
| 2005/0074257 | A1* | 4/2005 | Batori | G03G 15/0942 399/104 |
| 2006/0133847 | A1 | 6/2006 | Burton | |

(Continued)

OTHER PUBLICATIONS

European Patent Office Search Report for Application No. 17786400.6 dated Mar. 1, 2019, 11 pages.

(Continued)

*Primary Examiner* — Sophia S Chen
(74) *Attorney, Agent, or Firm* — Michael Best & Friedrich LLP

(57) ABSTRACT

A method of modifying a toner hopper including a toner window and an end cap. The method including providing a slot on the end cap and applying a toner seal covering the toner window, the toner seal including a pull tab. The method further including applying an end seal to the toner hopper, the end seal providing a gap and placing the pull tab within the gap and the slot.

12 Claims, 9 Drawing Sheets

(56) References Cited

U.S. PATENT DOCUMENTS

| | | | |
|---|---|---|---|
| 2009/0245853 | A1 | 10/2009 | Lewis et al. |
| 2011/0255897 | A1 | 10/2011 | Sato |
| 2013/0084098 | A1 | 4/2013 | Kanazawa et al. |

OTHER PUBLICATIONS

International Search Report and Written Opinion received in International Application No. PCT/US2017/027888, dated Jun. 29, 2017 (6 pages).
European Patent Office Search Report for Application No. 17786400.6, dated Jul. 23, 2019, 12 pages.

* cited by examiner

TONER CARTRIDGE AND METHOD OF SEALING THE SAME

CROSS-REFERENCE TO RELATED APPLICATIONS

This application claims priority to, prior-filed U.S. Provisional Patent Application No. 62/325,020, filed Apr. 20, 2016, the entire contents of which are incorporated by reference.

BACKGROUND

The invention generally relates to imaging, or printer, cartridges.

SUMMARY

Printing systems, such as high volume printing devices (e.g., network printers, photocopiers, etc.) typically use toner cartridges which store and transmit toner to an intended medium, such as paper. Once the toner has depleted, the used toner cartridge is removed from the printing system, and typically disposed of. Remanufacturing of used toner cartridges permits the toner cartridges to be reused rather than disposed of in landfills.

Toner cartridges come in a variety of configurations. Although specific constructions vary among manufacturers and printers, many toner cartridges include components such as a toner hopper, a variety of toner-regulating blades, a developer roller, a primary charge roller, and an organic photo-conductor drum.

To avoid discarding useful materials and to thereby reduce the environmental impact of printing operations, many toner cartridges may be remanufactured. Remanufacturing involves collecting used toner cartridges that, prior to their use, were brand new cartridges typically supplied by the manufacturer of the printer with which the cartridges are compatible. These cartridges are often referred to in the art as "OEM cartridges" because they are supplied by the original equipment manufacturer, i.e., the manufacturer of the printer and the compatible printer cartridge.

Remanufacturing of toner cartridges typically includes, among other things, disassembling the toner cartridge, cleaning the toner cartridge, refilling the toner hopper with new toner, repairing or replacing worn or damaged components, and reassembling the toner cartridge. Reassembly the toner cartridge typically includes providing a toner seal that covers a toner opening provided in the toner hopper through which toner is dispensed during operation of the cartridge. These seals are removable either manually by a user or by a mechanism included in the toner cartridge or the image forming apparatus into which it is installed just prior to the toner cartridge being used for a printing operation. The primary function of the seal is to prevent toner from leaking out of the toner opening of the cartridge during transportation and shipping of the toner cartridge.

Once the toner cartridge is remanufactured, a post-test is often times performed before the toner cartridge is packaged for sale to the end user. The post-test is intended to reveal any issues that may have arisen during the remanufacturing process. If the post-test reveals a printing defect the cartridge can be removed from the production line and the issue investigated. Although the specific technique may vary depending on the configuration of a specific cartridge, to conduct a post-test remanufacturers will often insert a relatively small test charge of toner into the space between the developer roller and the "clean" side of the toner seal. In a typical post-test the toner seal remains intact and print tests are conducted using the test charge of toner which makes its way through the cartridge in the same manner as toner from the hopper would if the toner seal was not present. When the post-test is complete remaining test charge toner may be vacuumed or blown from the cartridge before packaging.

Toner cartridges such as those disclosed in U.S. Pat. No. 8,958,726 (the '726 patent) include a rotatable member within the toner hopper that removes an internal toner seal. Before the cartridge is inserted into a printer, the internal toner seal prevents toner from leaking out of a toner accommodating area, which in the case of the '726 patent is in the form of a flexible container. When the cartridge is inserted into the printer, a driving rotatable force from the printer is transmitted to the cartridge through a drive mechanism. The drive mechanism operates a gear assembly in the cartridge which in turn rotates the rotatable member. When the rotatable member rotates it pulls the internal toner seal away from the toner accommodating area, thereby allowing toner to flow through the cartridge toward the developer roller. Because the internal toner seal is automatically removed when the cartridge is inserted into the printer, post-testing a cartridge that is remanufactured back to its original configuration would cause the internal toner seal to be removed, resulting in undesirable leaking of toner from the cartridge during packaging and shipment.

The invention resolves this issue by, in one embodiment, providing a method of modifying a toner hopper including a toner window and an end cap. The method including providing a slot on the end cap and applying a toner seal covering the toner window, the toner seal including a pull tab. The method further including applying an end seal to the toner hopper, the end seal providing a gap and placing the pull tab within the gap and the slot.

In another embodiment the invention provides a modified toner hopper including a toner window, a developer roller, a concave surface, an end seal, and a toner seal. The concave surface receives the developer roller. The end seal is coupled to the concave surface and seals an area between the toner hopper and the developer roller. The toner seal covers the toner window and includes a pull tab configured to extend between the concave surface and the developer roller.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
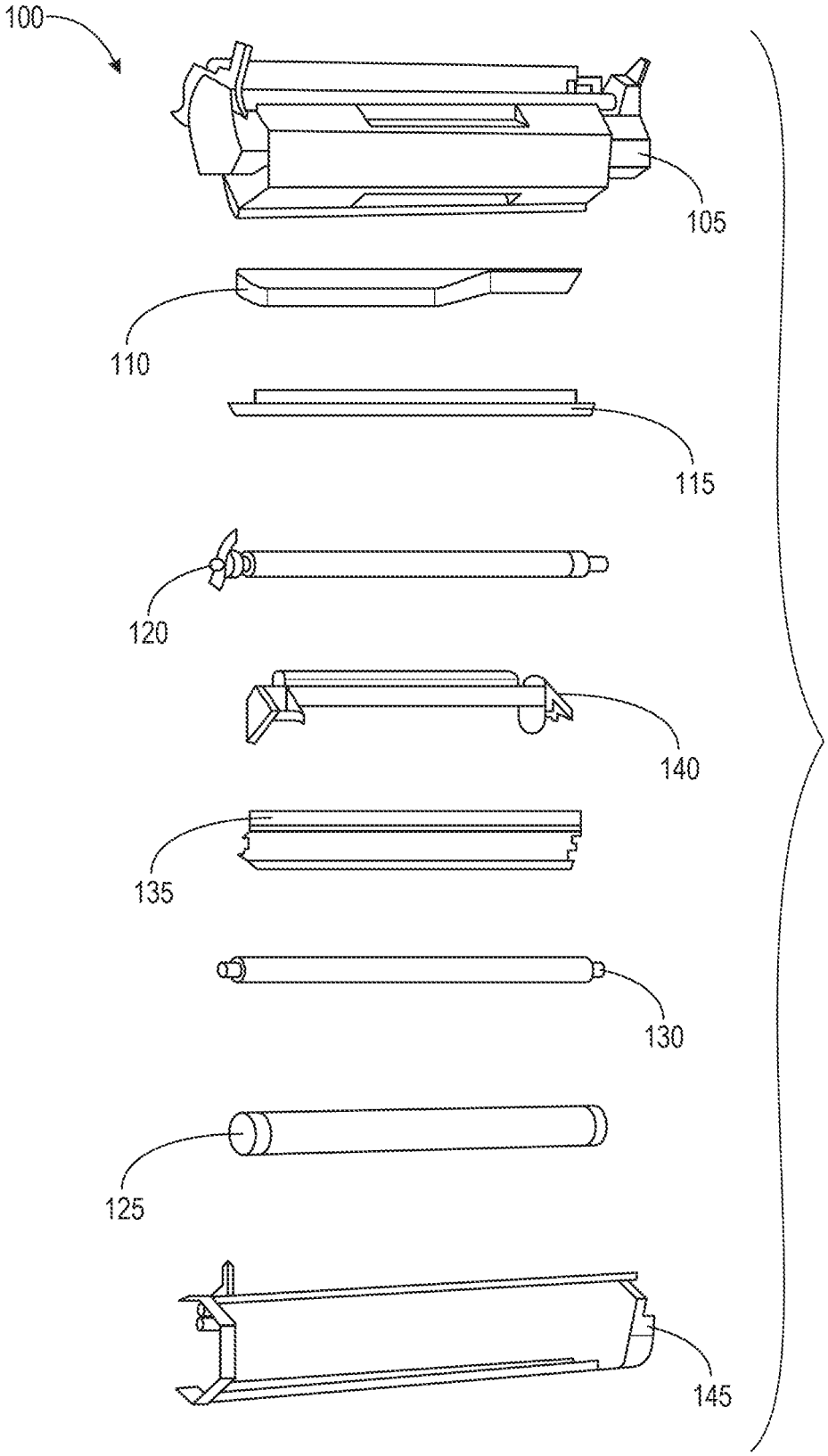
FIG. 1 illustrates an exploded view of a toner cartridge according to one embodiment of the invention.

FIG. 1 is an exploded view of a toner cartridge 100 according to one embodiment of the invention. The toner cartridge 100 is a consumable component used in a printing system (e.g., network printers, laser printers, photocopiers, etc.). The toner cartridge 100 stores and, in cooperation with components of a compatible printer, transfers toner to an intended medium (e.g., paper). Toner typically has a predetermined toner electrical potential, and is therefore attracted to elements or components having a different electrical potential. For example, toner may be attracted to components having a more negative, more positive, or opposite electrical potential relative to the toner electrical potential. Therefore, during printing, the toner can be transmitted via a series of progressively increasing, progressively decreasing, or opposite electrical potentials that "hand off" the toner from component to component.

The toner cartridge 100 includes a toner hopper 105 for storing a mass of toner. In some embodiments, the toner hopper 105 is provided with a seal, or toner seal, 110. The seal 110 prevents toner from spilling prior to installation into the printing system. In some embodiments, the seal 110 is a removable protective strip. In other embodiments, the toner hopper 105 is a non-pull seal toner hopper. In such an embodiment, the toner hopper 105 includes an internal toner seal that is automatically removed during operation by the end user. In some embodiments, the seal 110 is composed of a polymer.

The toner cartridge 100 of the illustrated embodiment is an "all-in-one" cartridge and further includes the following components or elements: a metering blade (e.g., a charge blade or doctor blade) 115; a developer roller (i.e., a magnetic roller or a developer unit) 120; an organic photoconductor (OPC) drum 125; and a primary charge roller (PCR) 130. In other embodiments, the toner cartridge 100 may include more or fewer components. For example, alternative embodiments of the cartridge 100 may be developer cartridges that do not include an OPC drum or a PCR. In such embodiments, the OPC drum and PCR may be part of the printer or may be provided as a separately removable drum unit.

During operation, toner is collected from the toner hopper 105 by the rotating developer roller 120 and electrostatically transferred from the developer roller 120 to the OPC drum 125. A laser system having a laser beam, located within the printing system, scans an electrostatic image onto the OPC drum 125 with the laser beam. In some printers, the electrostatic image produced by the laser corresponds to the image to be printed. In other printers, the laser forms an electrostatic image that is a negative of the image that is to be printed. Regardless of the specific configuration, toner carried by the developer roller 120 is electrostatically attracted to the electrostatic image produced on the OPC drum 125 by the laser beam. The OPC drum 125 then applies the toner, which is in a pattern corresponding to the desired image, onto the intended medium by direct contact or by further electrostatic transfer. The toner is then fused to the intended medium, typically by way of a heating element (e.g., a fuser).

The toner cartridge 100 further includes a wiper blade 135. The wiper blade 135 remains in constant contact with the OPC drum 125 and wipes residual toner (i.e., toner remaining on the OPC drum 125 after transfer to the intended medium) from the OPC drum 125. The wiped residual toner is collected by a waste bin 140.

In some embodiments, the toner cartridge 100 further includes a drum shutter 145. The drum shutter 145 protects the OPC drum 125 from physical damage and exposure to light when the toner cartridge 100 is not installed in the printing system.

Figure 2:
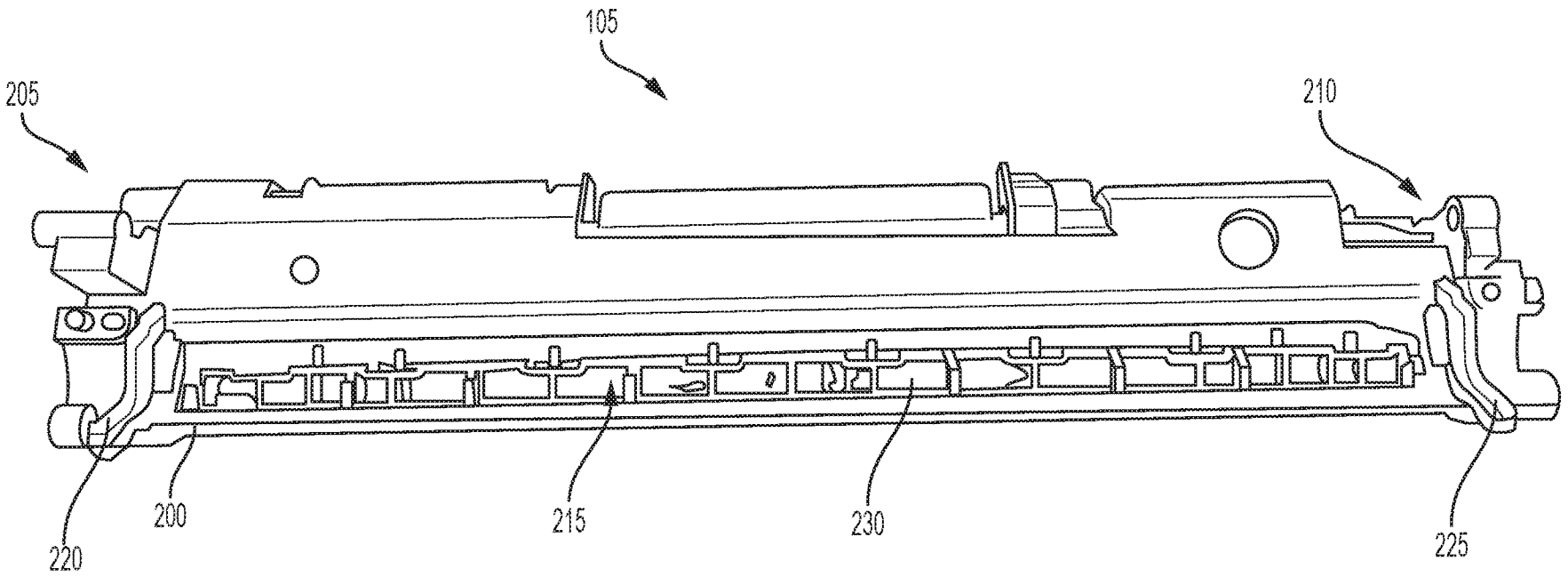
FIG. 2 illustrates a front view of a toner hopper of the toner cartridge of FIG. 1 according to one embodiment of the invention.
Figure 3:
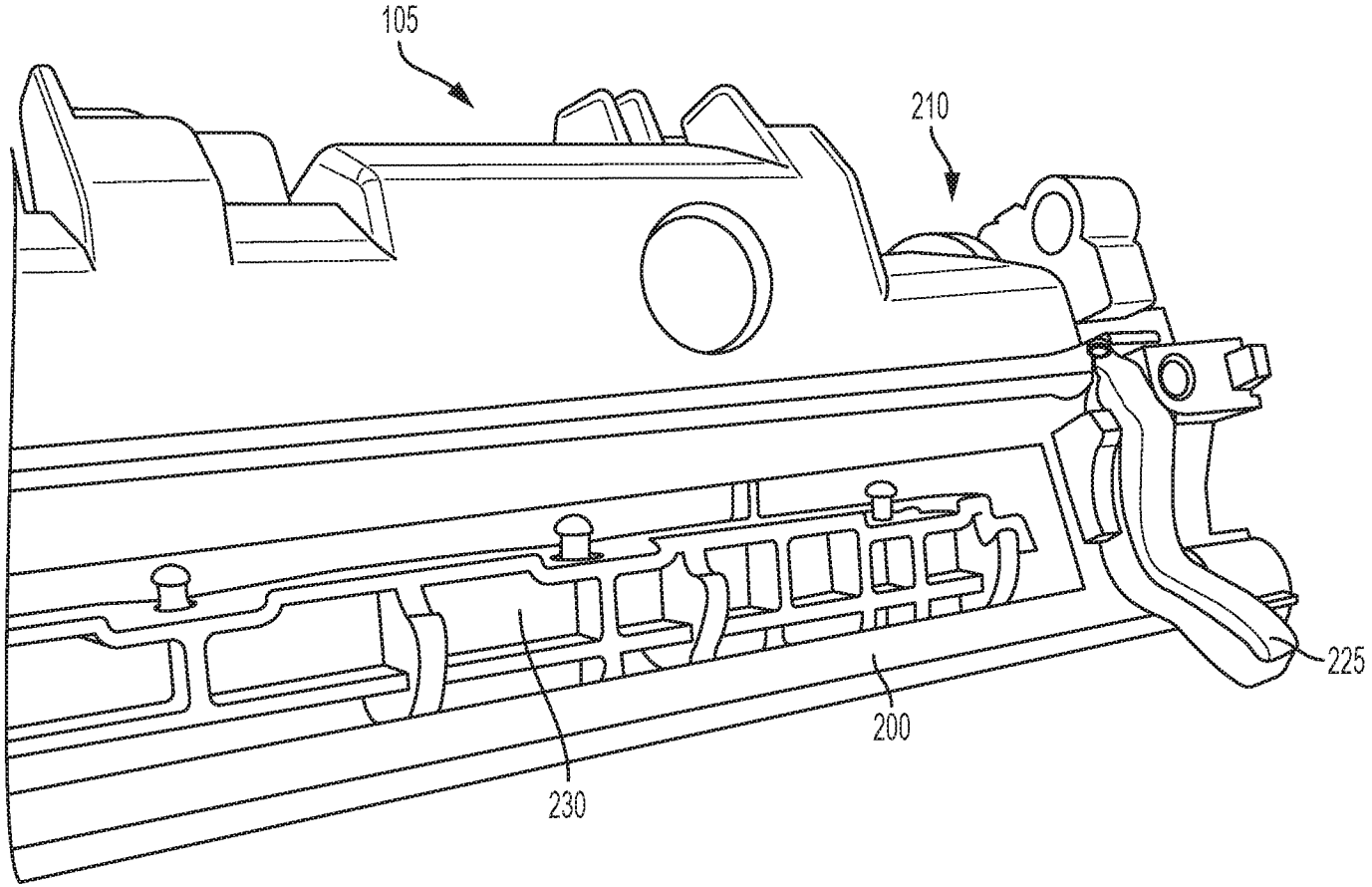
FIG. 3 illustrates a perspective view of the toner hopper of FIG. 2 according to one embodiment of the invention.

FIGS. 2 and 3 illustrate the toner hopper 105 without the toner seal 110, according to one embodiment of the invention. As illustrated in FIGS. 2 and 3, the toner hopper 105 includes a hopper wall 200, a first hopper end 205, a second hopper end 210, a toner window, or toner opening, 215, a first end seal 220, and a second end seal 225. A toner agitator 230 is rotatably mounted within the toner hopper 105 and rotates during printing operations to feed toner toward and through the toner window 215. The first end seal 220 is coupled to the hopper wall 200 near the first hopper end 205, while the second end seal 225 is coupled to the hopper wall 200 near the second hopper end 210.

Figure 4:
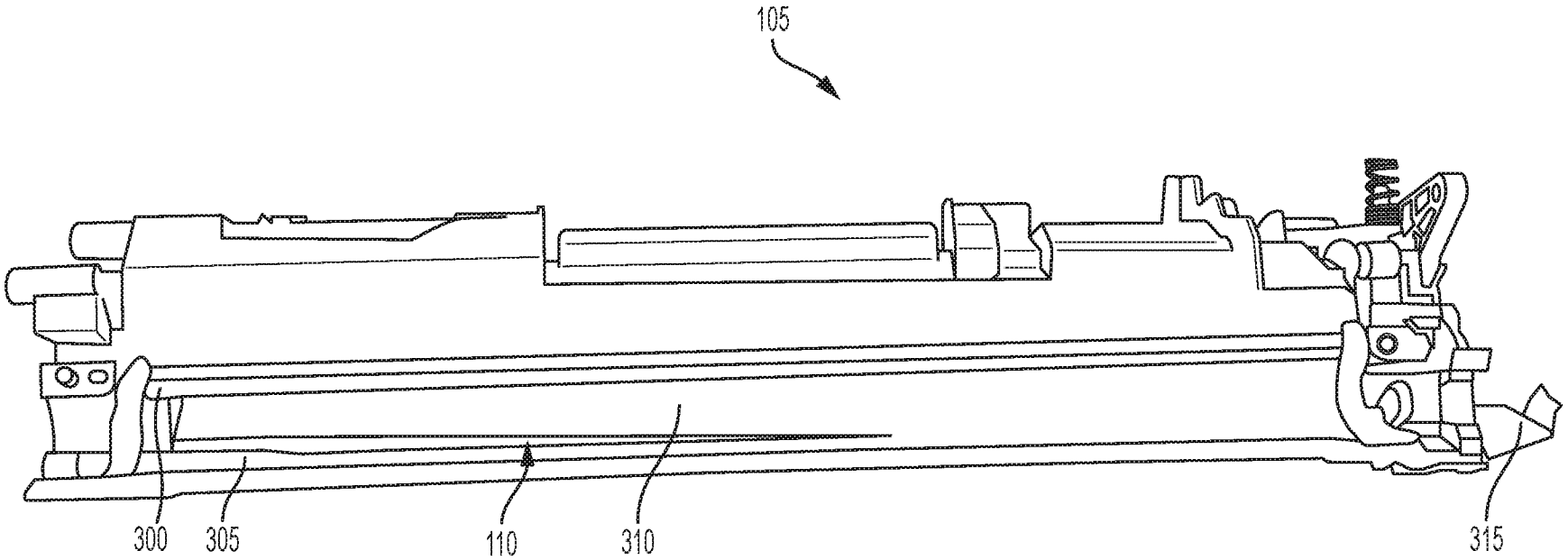
FIG. 4 illustrates a front view of a toner hopper having a toner seal of the toner cartridge of FIG. 1 according to one embodiments of the invention.

FIG. 4 illustrates a front view of the toner hopper 105 with the toner seal 110 covering the toner window 215, according to one embodiment of the invention. In the illustrated embodiment, the toner seal 110 includes a first coupling portion 300, a second coupling portion 305, a tear away portion 310, and a pull tab 315. The first coupling portion 300 and the second coupling portion 305 couple to a portion of the hopper wall 200 that surrounds the toner window 215. In some embodiments, the first and second coupling portions 300, 305 are coupled to the hopper wall 200 via adhesive. The tear away portion 310 is configured to tear away from the first and second coupling portions 300, 305 and be removed by the end user so that toner may be dispensed through the toner window 215 during operation. In the illustrated embodiment, the end user pulls on the pull tab 315 to remove the tear away portion 310 so that the toner cartridge 100 may be used.

Figure 5:
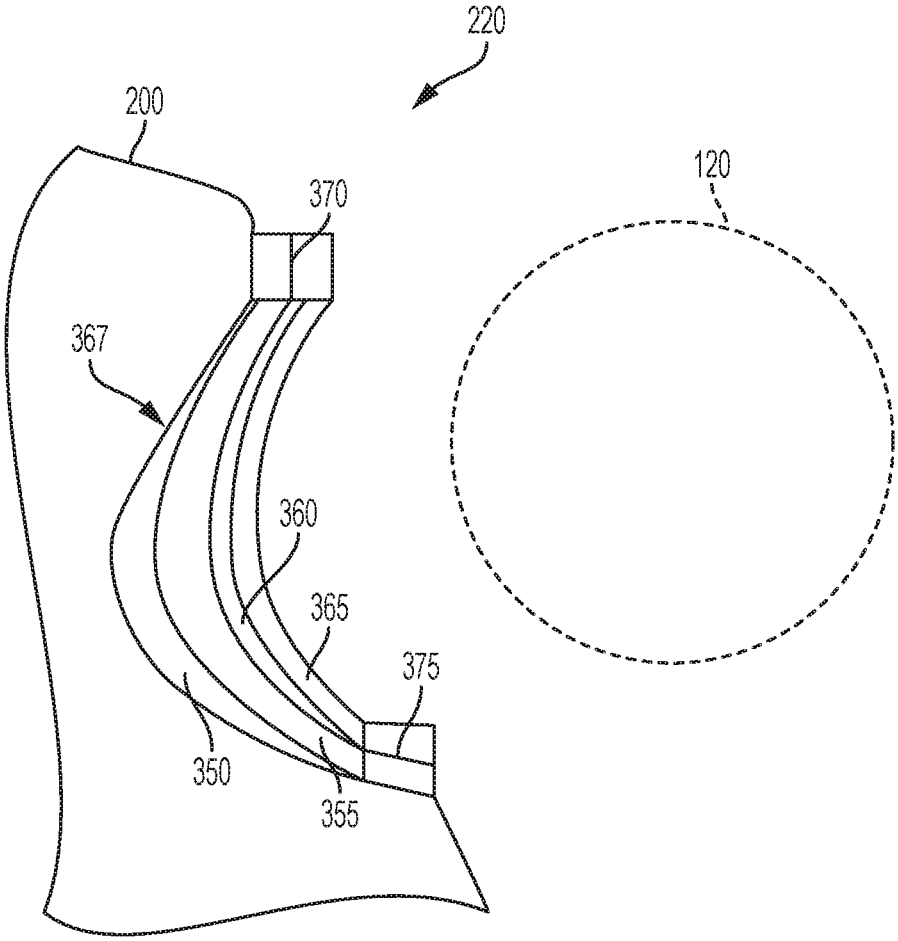
FIG. 5 illustrates a side view of an end seal of the toner hopper of FIG. 2 according to one embodiment of the invention.

FIG. 5 illustrates a side view of the first end seal 220 according to some embodiments of the invention. In some embodiments, the second end seal 225 is substantially similar to the first end seal 220 illustrated in FIG. 4. In some embodiments, the first end seal 220 includes a first gap 350, a first layer 355, a second gap 360, and a second layer 365. The optional first gap 350 is provided between a concave surface 367 of the hopper wall 200 and the first layer 355. The optional second gap 360 is provided between the first layer 355 and the second layer 365. The first layer 355 and the second layer 365 may be coupled together at a first seal end 370 and at a second seal end 375. In some embodiments, the first layer 355 and the second layer 365 may be coupled via adhesive. In some embodiments, the first gap 350 is configured to receive the first and second coupling portions 300, 305, the tear away portion 310, and the pull tab 315 of the seal 110. In other embodiments, the first gap 350 is configured to receive the first and second coupling portions 300, 305 and the tear away portion 310, while the second gap 360 is configured to receive the pull tab 315 of the seal 110. In other embodiments, the first gap 350 is eliminated and the first layer 355 is coupled (e.g., with adhesive) to the concave surface 367 substantially along its entire length. In each embodiment, when the developer roller 120 (illustrated in FIG. 5 as exploded and in phantom) is mounted to the toner hopper, the end seal 220 is compressed between the concave surface 367 and the developer roller 120 to form a seal that reduces toner leakage from the toner hopper 105.

Figure 6:
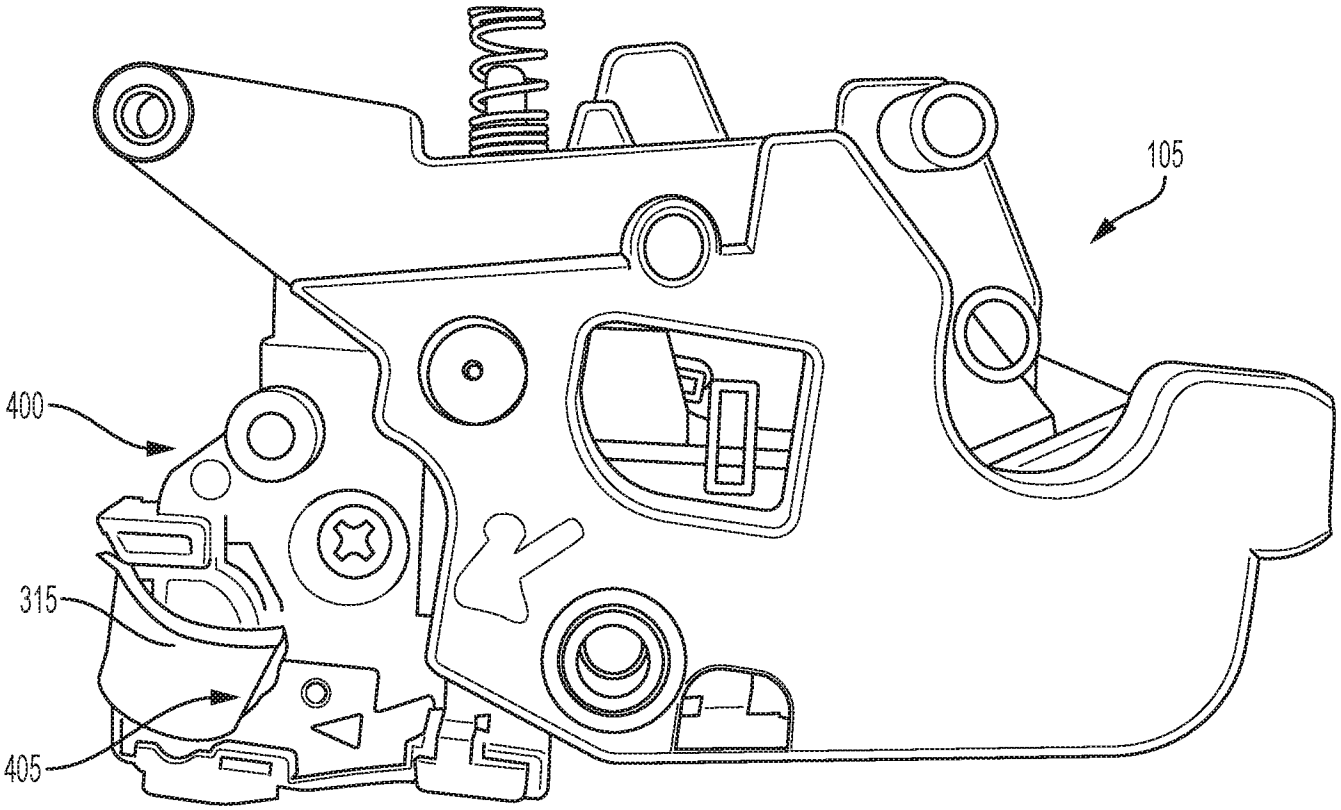
FIG. 6 illustrates a side view of the toner hopper of FIG. 4 according to some embodiments of the invention.

FIG. 6 illustrates a side view of the toner hopper 105. In the illustrated embodiment, the toner hopper 105 further includes an end cap 400 having an end slot 405. The end slot 405 is configured to receive the pull tab 315 of the seal 110.

Often times after remanufacture of the toner cartridge 100, the toner cartridge 100 is operated one or more times before being sold to the end user. Operation of the toner cartridge 100 may include testing of the toner cartridge 100, such as but not limited to, post-testing the toner cartridge 100 for quality control purposes. A post-test includes installing the toner cartridge 100 in a printing system and using the printing system, along with the installed toner cartridge 100, to print one or more test pages in order to confirm proper operation of the remanufactured cartridge 100.

In some embodiments, the remanufactured cartridge 100 is of the type described above wherein when the cartridge is new (i.e., before it has been remanufactured), the cartridge 100 includes an internal toner seal (not shown) that is pulled away from the toner window 215 when the cartridge 100 is first installed into a printer. More specifically, in the illustrated embodiment, when the cartridge is new, the toner agitator 230 also functions as a seal puller such that rotation of the toner agitator 230 removes the internal toner seal. Because the internal toner seal is automatically removed when the cartridge 100 is inserted into the printer, if the remanufacturer wants to post-test the cartridge 100 after remanufacturing, the cartridge 100 cannot be remanufactured back to its exact original configuration because the post-test would cause the internal toner seal to be removed, resulting in undesirable leaking of toner from the cartridge during packaging and shipment.

Thus, in some embodiments of operation, instead of an internal toner seal that is automatically removed, the toner hopper 105 is provided with the seal 110 prior to post-testing. In such an embodiment, because the toner hopper 105 remains sealed when the cartridge is installed, toner does not transfer from the toner hopper 105 to the developer roller 120 during the post-test. Rather, prior to post-testing, a test charge of toner is applied between the developer roller 120 and the "clean" side of the seal 110 that is opposite the toner hopper 105. The toner cartridge 100 is then installed in a printing system and, while the seal 110 remains in place, one or more test pages are printed in order to confirm proper operation of the remanufactured cartridge 100. In such an embodiment, the seal 110 is removed by the end user in the manner discussed above before installing the toner cartridge 100 into a printer.

Figure 7:
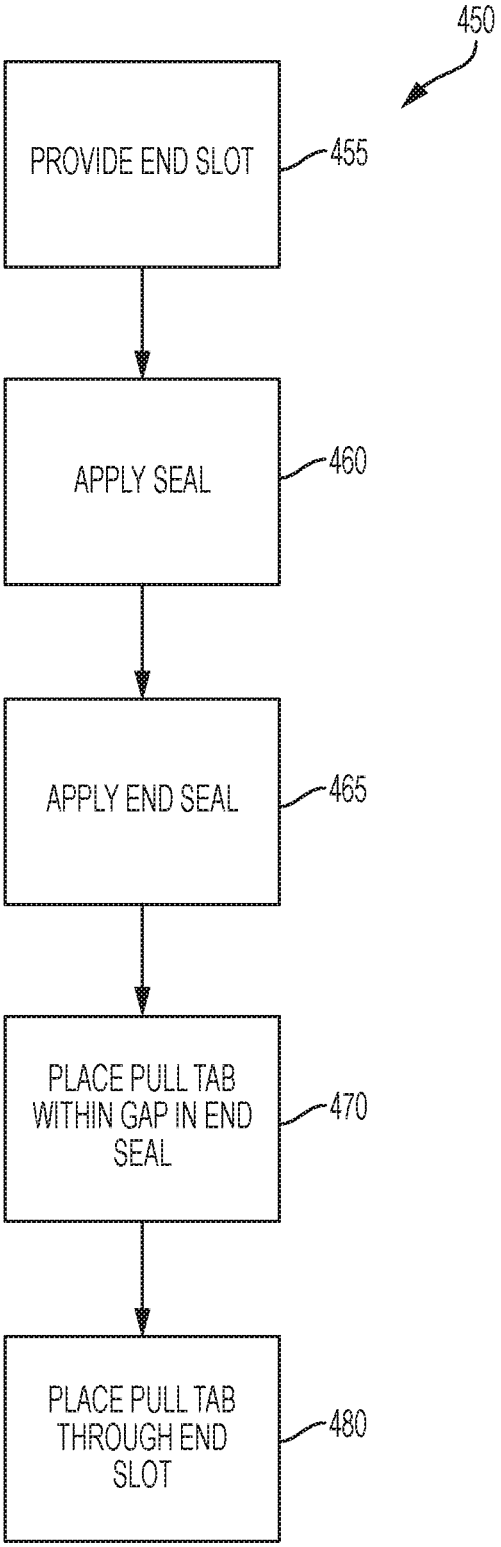
FIG. 7 is a flow chart illustrating a process of modifying a toner hopper of the toner cartridge of FIG. 1 according to one embodiment.

FIG. 7 is a flowchart illustrated a process, or operation, 450 for modifying a toner hopper according to one embodiment of the invention. It should be understood that the order of the steps disclosed in process 500 could vary. Furthermore, additional steps may be added to the sequence and not all of the steps may be required. Although other applications are possible, in some embodiments the toner hopper is modified from a toner hopper configured to use an internal toner seal that is automatically removed when the toner hopper is installed into a printer to a toner hopper having a pull-type seal such as the seal 110 described above. The end slot 405 is provided in the toner hopper 105 (step 455) to accommodate the pull tab 315 of the seal 110. In some embodiments, the end slot 405 is cut into the end cap 400. The seal 110 is applied to the toner hopper 105 (step 460). As discussed above, in some embodiments applying the seal 110 to the toner hopper 105 includes coupling the first and second coupling portions 300, 305 to the portion of the hopper wall 200 surrounding the toner window 215.

An end seal (e.g., first and/or second end seals 220, 225) is applied to the toner hopper 105 (step 465). As discussed above, in some embodiments the end seal provides a gap. In some embodiments, before the end seal is applied, an OEM end seal is removed. In other embodiments, the end seal is applied by cutting the gap into an existing OEM end seal. The pull tab 315 of the seal 110 is placed within the gap of the end seal (step 470), and the pull tab 315 of the seal 110 is placed through the end slot 405 (step 480).

Figure 8:
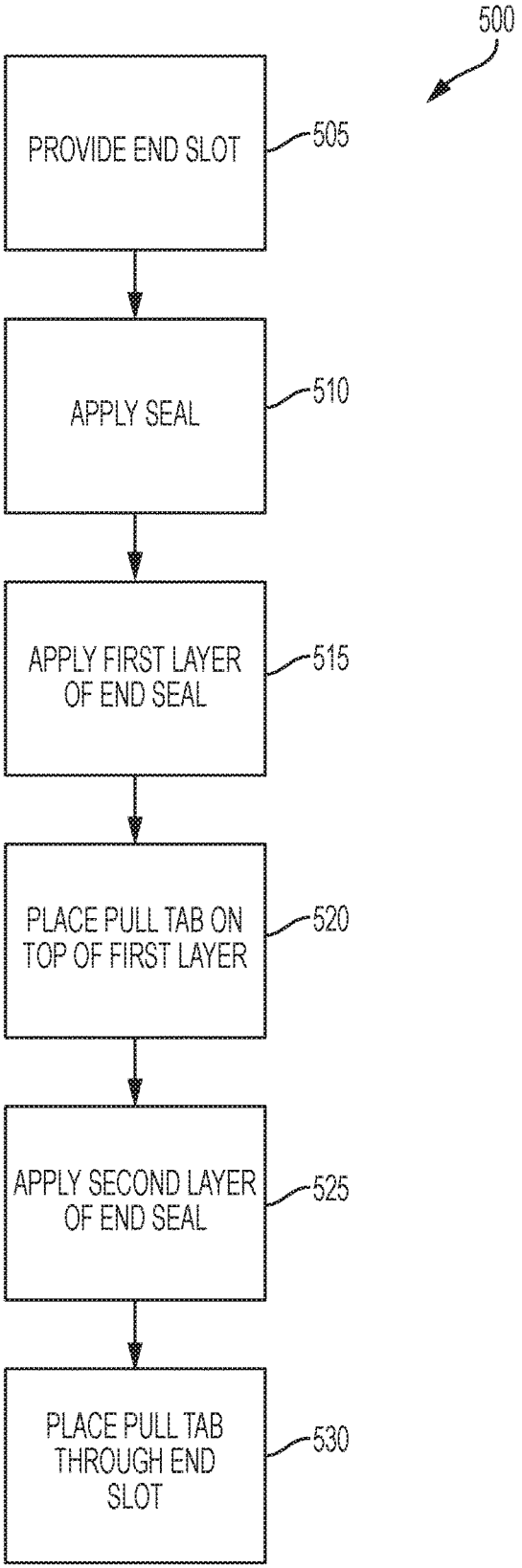
FIG. 8 is a flow chart illustrating a process of modifying a toner hopper of the toner cartridge of FIG. 1 according to another embodiment.

FIG. 8 is a flowchart illustrating a process, or operation, 500 for modifying a toner hopper according to one embodiment of the invention. It should be understood that the order of the steps disclosed in process 500 could vary. Furthermore, additional steps may be added to the sequence and not all of the steps may be required. The end slot 405 is provided in the toner hopper 105 (step 505). In some embodiments, the end slot 405 is cut into the end cap 400. The seal 110 is applied to the toner hopper 105 (step 510). As discussed above, in some embodiments applying the seal 110 to the toner hopper 105 includes coupling the first and second coupling portions 300, 305 to the portion of the hopper wall 200 surrounding the toner window 215. The first layer 355 of the first end seal 220 is applied to the first hopper end 205 (step 515). In some embodiments, before the first layer 355 is applied, an OEM end seal is removed. The pull tab 315 of the seal 110 is positioned over the first layer 355 (step 520). The second layer 365 of the first end seal 220 is positioned over the pull tab 315 and applied to its respective first layer 355 (step 525). When the second layer 365 is applied to its respective first layer 355, it cooperates with the first layer 355 to define the end seal gap through which the pull tab 315 extends. The pull tab 315 of the seal 110 is placed through the end slot 405 (step 530).

Figure 9:
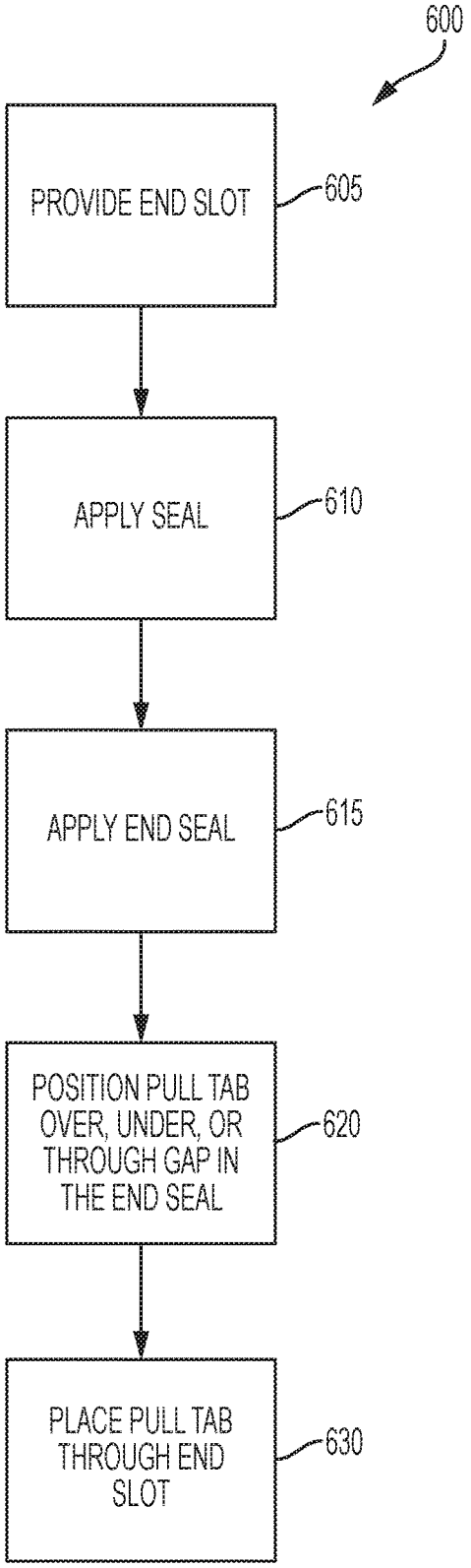
FIG. 9 is a flow chart illustrating a process of modifying a toner hopper of the toner cartridge of FIG. 1 according to another embodiment.

FIG. 9 is a flowchart illustrating a process, or operation, 600 for modifying a toner hopper according to another embodiment of the invention. It should be understood that the order of the steps disclosed in process 600 could vary. Furthermore, additional steps may be added to the sequence and not all of the steps may be required. The end slot 405 is provided in the toner hopper 105 (step 605). In some embodiments, the end slot 405 is cut into the end cap 400. Next, the seal 110 is applied to the toner hopper 105 (step 610). As discussed above, in some embodiments applying the seal 110 to the toner hopper 105 includes coupling the first and second coupling portions 300, 305 to the portion of the hopper wall 200 surrounding the toner window 215. At least a first end seal 220 is applied to the portion of the hopper wall 200 surrounding the toner window 215 (step 615). In some embodiments, before the end seal 220 is applied, an OEM end seal is removed. The pull tab 315 of the seal 110 is then placed over the first end seal 220, under the first end seal 220, or through a gap in the first end seal 220 (step 620). The pull tab 315 may then be placed through the end slot 405 (step 630). In some embodiments, the pull tab 315 is placed through the second gap 360 and the end slot 405 by feeding, or pulling, the pull tab 315 through the second gap 360 and the end slot 405. In other embodiments, the pull tab 315 is placed through the first gap 350 and the end slot 405 by feeding, or pulling, the pull tab 315 through the first gap 350 and the end slot 405. In yet other embodiments, the pull tab 315 is placed on top of the end seal 220 and then fed, or pulled, through the end slot 405. In such an embodiment, the end seal 220 may be an unmodified OEM end seal.

In some of the above-described embodiments, an OEM toner hopper configured to use an internal toner seal that is automatically removed by rotation of the agitator upon insertion of the toner hopper into a printer is modified to use a pull-type seal that is removed by an end user before placing the toner hopper into a printer. Steps included in the modification process may include adding a slot in a side area of the toner hopper, such as in the end cap, so the pull tab of a pull-type seal can extend therethrough. This may be accomplished by cutting a slot in the original end cap or by replacing the original end cap with a new end cap that has a slot pre-formed therein. The modification process may also include modifications to the developer roller end seals to allow a pull-type toner seal to extend therethrough. This may be accomplished by replacing the original end seal with a modified end seal or end seal assembly having a gap or slot formed therein through which the pull tab of a pull-type toner seal can extend. In other embodiments, an OEM developer roller end seal may be modified (e.g., cut) to provide a gap or slot through which the pull tab can extend. In still other embodiments, the OEM developer roller end seal may not be modified and the pull tab of the pull-type toner seal may be positioned over the end seal between the end seal and the developer roller. In each embodiment, when the pull tab of the pull-type toner seal extends between the outer surface of the developer roller and the concaved surface of the hopper wall. In embodiments where the pull tab extends through the second gap, the pull tab extends between the second layer and the concaved surface. In embodiments where the pull tab extends through the first gap, the pull tab extends between the first layer and the concaved surface.

Thus, the invention provides, among other things, a remanufactured toner hopper and a method of remanufacturing a toner hopper, and more specifically, a non-pull seal toner hopper. Various features and advantages of the invention are set forth in the following claims.

What is claimed is:

1. A method of modifying a toner hopper including a toner window and an end cap, the method comprising:

providing a slot on the end cap;

applying a toner seal covering the toner window, the toner seal including a pull tab;

applying an end seal to the toner hopper, the end seal providing a gap; and placing the pull tab within the gap and the slot, wherein the end seal includes a first layer and a second layer, and wherein the gap is provided between the first layer and the second layer.

2. The method of claim 1, wherein the step of placing the pull tab in the gap includes applying the first layer to the toner hopper, placing a portion of the pull tab on top of the first layer, and applying the second layer on top of a portion of the pull tab.

3. The method of claim 1, wherein the step of placing the pull tab in the gap and the slot includes feeding the pull tab through the gap and the slot.

4. The method of claim 1, further comprising applying a second end seal.

5. The method of claim 4, wherein the first end seal is applied near a first side of the toner window and the second end seal is applied near a second side of the toner window, the second side opposite the first side.

6. The method of claim 1, wherein the toner seal further includes a tear away portion.

7. A modified toner hopper comprising:

a toner window;

a developer roller;

a concave surface for receiving the developer roller;

an end seal coupled to the concave surface and sealing an area between the toner hopper and the developer roller; and a toner seal covering the toner window, the toner seal including a pull tab configured to extend between the concave surface and the developer roller;

wherein the end seal includes a first layer and a second layer and a gap is provided between the first layer and the second layer.

8. The modified toner hopper of claim 7, wherein the pull tab extends through the gap.

9. The modified toner hopper of claim 7, further comprising a second end seal.

10. The modified toner hopper of claim 9, wherein the first end seal is located near a first side of the toner window and the second end seal is located near a second side of the toner window, the second side opposite the first side.

11. The modified toner hopper of claim 7, wherein the toner seal further includes a tear away portion.

12. The modified toner hopper of claim 11, wherein the tear away portion is configured to be removed by a user pulling the pull tab.

* * * * *